US010342292B2

(12) United States Patent
Del Biondi et al.

(10) Patent No.: US 10,342,292 B2
(45) Date of Patent: Jul. 9, 2019

(54) SOLE FOR FOOTWEAR

(71) Applicant: The Rockport Company, LLC, Newton, MA (US)

(72) Inventors: Alberto Del Biondi, Padua (IT); Alessio Rizzi, Santa Maria di Sala (IT)

(73) Assignee: Rockport IP Holdings, LLC, Newton, MA (US)

( * ) Notice: Subject to any disclaimer, the term of this patent is extended or adjusted under 35 U.S.C. 154(b) by 63 days.

(21) Appl. No.: 15/543,749

(22) PCT Filed: Jan. 19, 2016

(86) PCT No.: PCT/IB2016/050246
§ 371 (c)(1),
(2) Date: Jul. 14, 2017

(87) PCT Pub. No.: WO2016/116855
PCT Pub. Date: Jul. 28, 2016

(65) Prior Publication Data

US 2018/0008007 A1 Jan. 11, 2018

(30) Foreign Application Priority Data

Jan. 19, 2015 (IT) ..... PD2015A0009

(51) Int. Cl.

| | |
|---|---|
| ***A43B 13/12*** | (2006.01) |
| ***A43B 23/22*** | (2006.01) |
| ***A43B 7/14*** | (2006.01) |
| ***A43B 13/18*** | (2006.01) |
| ***A43B 13/14*** | (2006.01) |

(52) U.S. Cl.
CPC ..... *A43B 23/222* (2013.01); *A43B 7/141* (2013.01); *A43B 13/12* (2013.01); *A43B 13/141* (2013.01); *A43B 13/181* (2013.01); *A43B 23/22* (2013.01)

(58) Field of Classification Search
CPC ..... A43B 13/12; A43B 13/125; A43B 23/22
USPC ..... 36/25 R, 30 R, 31
See application file for complete search history.

(56) References Cited

U.S. PATENT DOCUMENTS

| | | | | |
|---|---|---|---|---|
| 1,895,660 A | | 1/1933 | Huck | |
| 4,348,821 A | * | 9/1982 | Daswick | A43B 13/12 36/103 |
| 4,798,010 A | * | 1/1989 | Sugiyama | A43B 13/12 36/28 |
| 5,528,842 A | * | 6/1996 | Ricci | A43B 13/12 36/103 |

(Continued)

FOREIGN PATENT DOCUMENTS

| | | |
|---|---|---|
| GB | 2493036 A | 1/2013 |
| WO | 2014068169 A1 | 5/2014 |

*Primary Examiner* — Marie D Bays
(74) *Attorney, Agent, or Firm* — St Onge Steward Johnston and Reens LLC

(57) ABSTRACT

A sole having respective forefoot, midfoot and backfoot parts, which are contiguous in a longitudinal direction running from toe to heel, and including a stiffening shank extending in the longitudinal direction from toe to heel. The shank extends over a predominant portion of the longitudinal development from the backfoot part to the forefoot part, and has areas of different flexibility alternating along the longitudinal development, the flexibility of these areas being progressively variable in a substantially continuous manner between one area and the contiguous areas.

14 Claims, 2 Drawing Sheets

(56) References Cited

U.S. PATENT DOCUMENTS

| | | | | |
|---|---|---|---|---|
| 5,572,805 | A * | 11/1996 | Giese | A43B 13/12 36/103 |
| 5,720,118 | A * | 2/1998 | Mayer | A43B 5/00 36/107 |
| 6,219,939 | B1 * | 4/2001 | Kita | A43B 13/12 36/25 R |
| 6,389,713 | B1 * | 5/2002 | Kita | A43B 13/026 36/28 |
| 6,625,905 | B2 * | 9/2003 | Kita | A43B 13/12 36/25 R |
| 6,785,986 | B1 | 9/2004 | Brand et al. | |
| 2001/0039745 | A1 * | 11/2001 | Nakano | A43B 5/00 36/25 R |
| 2002/0184793 | A1 * | 12/2002 | Sato | A43B 13/12 36/30 R |
| 2003/0000108 | A1 * | 1/2003 | Kita | A43B 13/12 36/28 |
| 2003/0000109 | A1 * | 1/2003 | Kita | A43B 13/12 36/30 R |
| 2007/0107264 | A1 | 5/2007 | Meschter et al. | |
| 2008/0244926 | A1 * | 10/2008 | Yu | A43B 7/1415 36/28 |
| 2009/0307925 | A1 * | 12/2009 | Pfister | A43B 7/223 36/28 |
| 2010/0146819 | A1 * | 6/2010 | Teteriatnikov | A43B 13/145 36/103 |
| 2010/0275471 | A1 * | 11/2010 | Teteriatnikov | A43B 13/145 36/30 R |
| 2014/0115920 | A1 | 5/2014 | McCue | |

* cited by examiner

SOLE FOR FOOTWEAR

FIELD OF THE INVENTION

The present invention relates to an improved sole for footwear, of the type having a predominantly longitudinal development and including a stiffening shank extending in a longitudinal direction.

BACKGROUND OF THE INVENTION

A sole having these characteristics is known, for example, from U.S. Pat. No. 1,895,660. The stiffening shank, termed an "arch support", extends in this case from a backfoot part to the beginning of the adjacent midfoot part, and serves mainly to reinforce the footwear in the plantar arch area.

U.S. Pat. No. 6,785,986 describes a torsion stiffening shank which also extends in the plantar arch area, running diagonally relative to the longitudinal direction.

US20070107264 describes a stiffening shank for sports footwear in which a series of semi-rigid plates are connected to one another via locally weakened areas which form hinge systems. In this case also, the extension of the shank is mainly limited to the plantar arch.

SUMMARY OF THE INVENTION

The object of these shanks or arch supports is to provide support to the user's foot, thereby improving walking comfort. However, it has been found that this improvement may be further enhanced by using a shank having non-conventional dimensions, rigidity and elastic performance.

The problem underlying this invention is therefore that of further improving the comfort of footwear by increasing the localized support of the foot.

This problem is resolved according to the invention by means of an improved sole made in accordance with the invention.

BRIEF DESCRIPTION OF THE DRAWINGS

The features and advantages of the invention will be made clearer by the following detailed description of a preferred but non-exclusive exemplary embodiment thereof, illustrated, for the purposes of guidance and in a non-limiting way, with reference to the attached drawings, in which.

DETAILED DESCRIPTION OF THE INVENTION

Figure 1:
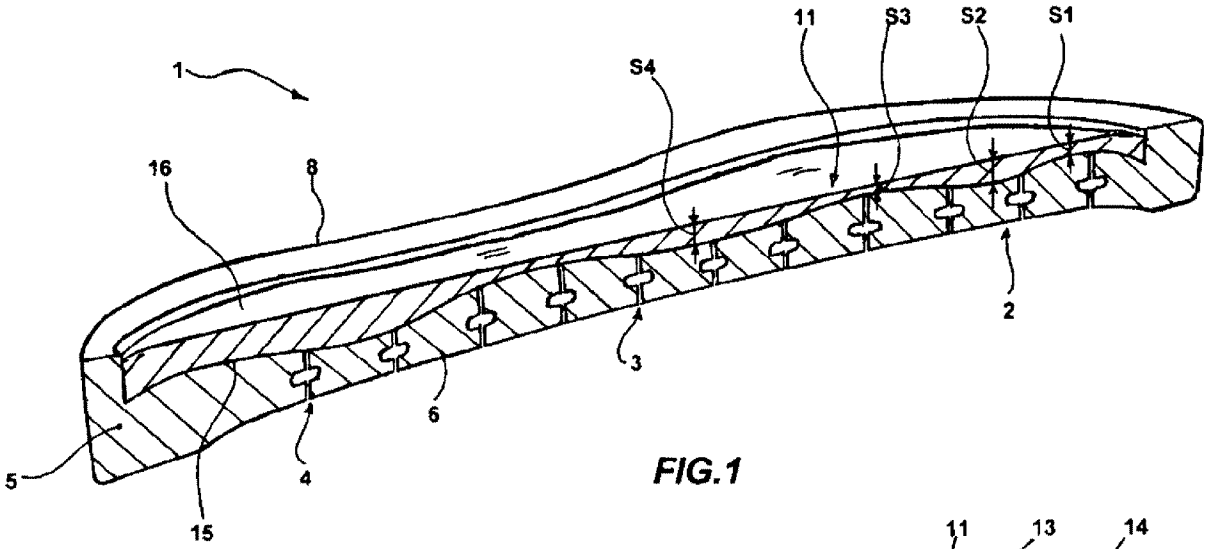
FIG. 1 is a sectional view of a sole according to the invention cut by a curved surface along the section A-A.
Figure 2:
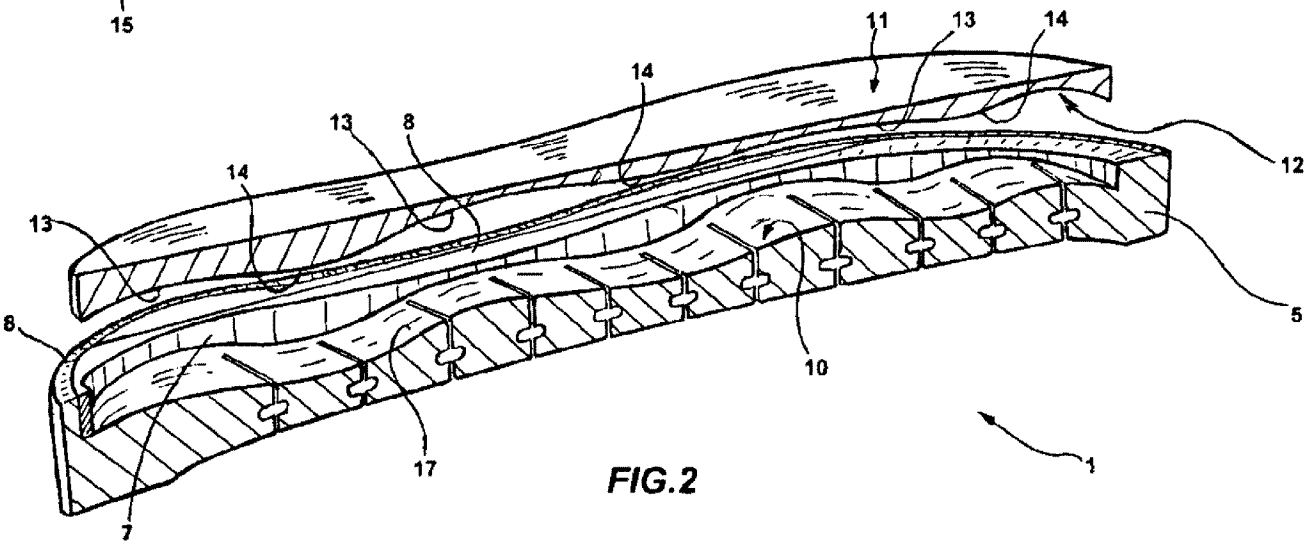
FIG. 2 is an exploded view of FIG. 1.
Figure 3:
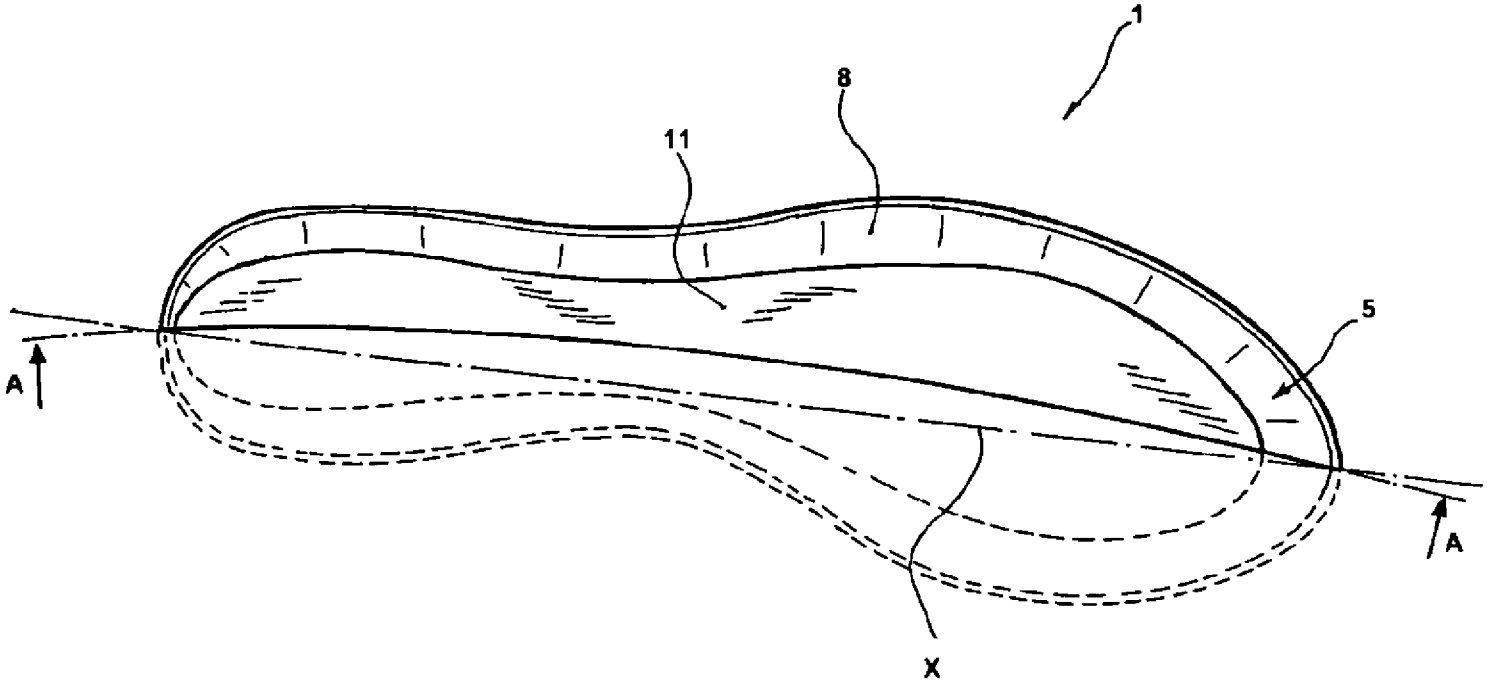
FIG. 3 is a plan view of a sole according to the invention.

In the figures, the number 1 indicates the whole of a sole for footwear made according to the present invention. Respective forefoot 2, midfoot 3 and backfoot 4 areas, which are contiguous in a longitudinal direction running from toe to heel (X), are identified in the sole 1. The sole 1 comprises a sole body 5 which has, on its underside, a tread surface 6 intended to bear on the ground during walking, while, on the opposite upper side, there is a recess 7 surrounded by a peripheral frame 8 extending around the edge of the sole body 5. A central cavity 10, the shape of which is described below, is formed in the surface of the upper side.

The cavity 10 is intended to house, with a positive connection, a stiffening shank 11 having a longitudinal extension matching the extension of the sole body 5, from the backfoot part 4 to the forefoot part 2. According to a preferred embodiment, the stiffening shank 11 has an alternation of areas of different flexibility, repeated along the longitudinal development. Preferably, the areas of different flexibility have a flexibility which varies progressively and continuously from one flexible area to the adjacent one.

This variation of flexibility is preferably provided by progressive variations in thickness S1, S2, S3, S4 of the stiffening shank 11 along its longitudinal development, and, even more preferably, the variations of thickness take the form of undulations 12 with troughs 13 followed by peaks 14.

Preferably, an area of greater thickness of the stiffening shank 11 alternates with an area of lesser thickness of the shank. This enables both flexibility and supporting capacity to be imparted to the footwear having the sole according to the present invention, using a single reinforcing element.

In one embodiment, the stiffening shank 11 has a first portion of greater thickness in the backfoot area 4, preferably at the heel.

Preferably, this area of greater thickness is followed, along the longitudinal development of the sole, by a portion of lesser thickness, which, by way of example, may be in the transitional area between the backfoot area and the midfoot area 3.

According to a preferred embodiment, a further portion of greater thickness is located in the midfoot area 3. Preferably, the forefoot area 2 also comprises a portion of greater thickness.

In one embodiment, the stiffening shank 11 has a portion of lesser thickness in the transitional area between the midfoot area 3 and the forefoot area 2.

According to a preferred embodiment, the stiffening shank 11 comprises a portion of greater thickness in each of the forefoot 2, midfoot 3 and backfoot 4 areas. These areas are preferably separated by respective portions of lesser thickness.

Preferably, the forefoot area 2 further comprises an area of lesser thickness near the longitudinal end of the sole.

In a preferred embodiment, the undulations 12 forming the areas of different thickness are present on only one side 15 of the shank 11. The opposite side 16 (in other words, the side facing the inside of the footwear in use) is essentially flat.

According to a preferred embodiment, the cavity 10 housing the stiffening shank 11 in the sole body 5 has a complementary shape to the shank 11. Preferably, the cavity 10 has a base surface 17 facing the side 15 of the shank 11 provided with an alternation of repeated undulations along the longitudinal development, distributed and shaped in such a way that the undulations 12 on the shank 11 and on the base 17 have complementary shapes to provide a male-female fit.

By its function and its position in the sole, the stiffening shank 11 forms an arch support for the sole 1.

The invention claimed is:

1. A sole comprising forefoot, midfoot and backfoot parts, which are contiguous in a longitudinal direction running from toe to heel, and including a stiffening shank extending in the aforesaid longitudinal direction from toe to heel, wherein:

the shank extends over a predominant portion of the longitudinal development from the backfoot part to the forefoot part with a first end adjacent to the sole's heel and a second end adjacent to the sole's toe, the shank has areas of different flexibility alternating along the longitudinal development, the flexibility of these areas being progressively variable in a substantially continuous manner between one area and the contiguous areas, the variable flexibility of these areas a result of progressive variation in the thickness of the shank along the longitudinal development, the progressive variation in the thickness being defined by portions of greater thickness alternating with portions of lesser thickness, and the shank has a first end thickness and a second end thickness and the shank's thickness undulates between the first end and second end, the shank comprising undulations which consist of exactly one portion of greater thickness in each of the forefoot, midfoot, and backfoot areas, exactly one portion of lesser thickness between the first end and the backfoot area, and exactly one portion of lesser thickness between the second end and the forefoot area.

2. The sole for footwear according to claim 1, wherein the shank has forefoot, midfoot and backfoot areas separated by respective portions of lesser thickness.

3. The sole according to claim 1, wherein the shank comprises two opposite faces and the variations in thickness take the form of undulations in which a wave trough alternates with a wave crest.

4. The sole according to claim 3, wherein the undulations are present on only one face of the shank.

5. The sole according to claim 4, wherein the face having the undulations is the opposite face from a face supporting the foot.

6. The sole according to claim 1, wherein the stiffening shank forms an arch support of the sole.

7. The sole according to claim 1, comprising a sole body on one face of which a recess is provided, and the stiffening shank is at least partially housed in this recess.

8. The sole according to claim 7, wherein the recess has a complementary shape to the shank.

9. The sole according to claim 8, wherein the recess has a plurality of undulations having a complementary shape to the undulations of the shank, providing a male-female fit.

10. A shoe sole comprising:

a sole body; and a shank, associated with the sole, having a continuously variable thickness and extending along a longitudinal axis thereof from a first end adjacent to a heel of the shoe sole to a second end adjacent to a toe of the shoe sole, the substantially continuously variable thickness being provided by alternating portions of progressively greater thickness and portions of progressively lesser thickness, the alternating portions of greater thickness and portions of lesser thickness providing the shank with substantially continuously variable flexibility, the shank comprising exactly one portion of greater thickness in each of a forefoot area, a midfoot area, and a backfoot area of the sole body, exactly one portion of lesser thickness between the shank's first end and the backfoot area, and exactly one portion of lesser thickness between the shank's second end and the forefoot area.

11. The shoe sole of claim 10, wherein the sole body has a forefoot part, a midfoot part, and a backfoot part, and wherein there is exactly one portion of progressively greater thickness of the shank in each of the forefoot part, the midfoot part, and the backfoot part.

12. The shoe sole of claim 10, wherein the shank has a lower surface with undulations and an essentially flat upper surface.

13. The shoe sole of claim 12, wherein the sole body has an upper surface with complementary undulations to the shank lower surface undulations so that the shank and sole have complementary shapes which fit together.

14. The shoe sole of claim 13, wherein the sole has a cavity therein and the shank is provided in the cavity.

* * * * *